US006804835B2

(12) United States Patent
Chou

(10) Patent No.: US 6,804,835 B2
(45) Date of Patent: Oct. 19, 2004

(54) LENS/FRAME ASSEMBLY FOR SWIMMING GOGGLES

(76) Inventor: Terry Chou, No. 12, Hsin Ho Herng Road, Tainan City (TW)

( * ) Notice: Subject to any disclaimer, the term of this patent is extended or adjusted under 35 U.S.C. 154(b) by 127 days.

(21) Appl. No.: 10/055,083

(22) Filed: Jan. 25, 2002

(65) Prior Publication Data

US 2003/0140403 A1 Jul. 31, 2003

(51) Int. Cl.[7] ..... A61F 9/02
(52) U.S. Cl. ..... 2/436; 2/439
(58) Field of Search ..... 2/426, 431, 434, 2/436, 439, 452, 454, 429, 441, 442, 443, 445, 446, 428; 351/43, 44, 62, 86, 106, 163

(56) References Cited

U.S. PATENT DOCUMENTS 4,279,040 A * 7/1981 Garofalo ..... 2/428
4,759,622 A * 7/1988 Schmidthaler ..... 351/86
4,951,322 A * 8/1990 Lin ..... 2/439
4,973,212 A * 11/1990 Jacobs ..... 411/508
5,410,763 A * 5/1995 Bolle ..... 2/436
5,768,716 A * 6/1998 Porsche ..... 2/454
5,802,622 A * 9/1998 Baharad et al. ..... 2/434
6,276,794 B1 * 8/2001 Chiang ..... 351/43
6,276,795 B1 * 8/2001 Hall et al. ..... 351/62
6,349,420 B1 * 2/2002 Chiang ..... 2/428
6,349,422 B1 * 2/2002 Schleger et al. ..... 2/431
6,405,384 B1 * 6/2002 Chiang ..... 2/428
6,473,909 B1 * 11/2002 Chou ..... 2/428

* cited by examiner

*Primary Examiner*—Gary L. Welch
(74) *Attorney, Agent, or Firm*—Charles E. Baxley

(57) ABSTRACT

A lens/frame assembly for swimming goggles comprises a frame made of rigid material with slight flexibility, two lens received in a lens-holding compartment of the frame, and a connecting block. The lens-holding compartment has a bridge portion in a middle thereof. A connecting block is securely received in the bridge portion of the lens-holding compartment and securely mounted to the frame to thereby securely retain the lenses in place.

8 Claims, 8 Drawing Sheets

LENS/FRAME ASSEMBLY FOR SWIMMING GOGGLES

BACKGROUND OF THE INVENTION

1. Field of the Invention

The present invention relates to a lens/frame assembly for swimming goggles with improved stability and integrity.

2. Description of the Related Art

FIGS. 11 and 12 of the drawings illustrate a pair of conventional swimming goggles comprising a frame 2', two lenses 1', two padding members 3', and a head straps 4'. Each lens 1' is made of rigid material and comprises two slots 11'. The frame 2' is also made of rigid material and comprises a bridge 21' in a middle thereof and two lens-receiving holes 22' on both sides of the bridge 21' for receiving the lenses 1'. An inner periphery defining each lens-receiving hole 22' has two. engaging members 23' for engaging with the slots 11' of the respective lens 1'. The frame 2' further comprises two engaging portions 24' at two sides thereof for engaging with the ends of the head strap 4'. In assembly, each lens 1' is forcibly inserted into the respective lens-receiving hole 22' until the slots 11' are engaged with the engaging members 23'. Nevertheless, although the frame 2' is made of rigid material to prevent deformation and the slots 11' are engaged with the engaging members 23', the lenses 1' are still slightly movable after assembly while the slots 11' and the engaging members 23' are exposed and thus adversely affect the overall aesthetically pleasing effect.

SUMMARY OF THE INVENTION

An object of the present invention is to provide a lens/frame assembly for swimming goggles with improved stability and integrity.

In accordance with an aspect of the invention, a lens/frame assembly for swimming goggles comprises a frame made of rigid material with slight flexibility, two lens received in a lens-holding compartment of the frame, and a connecting block. The lens-holding compartment has a bridge portion in a middle thereof. A connecting block is securely received in the bridge portion of the lens-holding compartment and securely mounted to the frame to thereby securely retain the lenses in place.

In accordance with another aspect of the invention, a pair of swimming goggles is provided and comprises a frame made of rigid material with slight flexibility, a connecting block, two lenses received in a lens-holding compartment of the frame, a padding member engaged with the lenses, and a head strap having two ends attached to two sides of the frame. The lens-holding compartment has a bridge portion in a middle thereof. Each lens includes a flange for engaging with the lens-holding compartment. The connecting block is securely received in the bridge portion of the lens-holding compartment and securely mounted to the frame. The bridge portion of the frame is pullable to allow insertion of the lenses into the lens-holding compartment and to allow engagement of the flange of each said lens with the lens-holding compartment. The flange of each lens is tightly received in the lens-holding compartment of the frame.

In an embodiment of the invention, the bridge portion of the frame comprises two engaging pieces respectively formed on an upper wall and a lower wall of the bridge portion. Each engaging piece includes an engaging hole. The connecting block comprises two pegs each having a snapping head having a diameter slightly greater than an inner diameter of an associated one of the engaging holes. The snapping head is compressed inward when it is passing through the associated one of the engaging holes. The snapping head restores its shape after it has passed through the associated one of the engaging holes. A connecting plate may be securely attached between the lenses.

In another embodiment of the invention, a connecting plate is securely attached between the lenses and comprises two first engaging holes. The bridge portion of the frame comprises two engaging pieces respectively formed on an upper wall and a lower wall of the bridge portion. Each engaging piece includes a second engaging hole. The connecting block comprises two pegs each having a snapping head having a diameter slightly greater than an inner diameter of an associated one of the first engaging holes. The snapping head is compressed inward when it is passing through an associated one of the second engaging holes and the associated one of the first engaging holes. The snapping head restores its shape after it has passed through the associated one of the first engaging holes.

In a further embodiment of the invention, a connecting plate is securely attached between the lenses and comprises a first engaging hole. The bridge portion of the frame comprises a front engaging piece and a rear engaging piece respectively formed on a lower wall and an upper wall of the bridge portion. The front engaging piece and the rear engaging piece include aligned second engaging holes. The connecting block comprises a peg having a snapping head having a diameter slightly greater than an inner diameter of the first engaging hole of the connecting plate. The snapping head is compressed inward when it is passing through the aligned second engaging holes and the first engaging hole. The snapping head restores its shape after it has passed through the first engaging hole of the connecting plate.

In still another embodiment of the invention, a connecting plate is securely attached between the lenses and comprises two first engaging holes. The bridge portion of the frame comprises two engaging pieces respectively formed on an upper wall and a lower wall of the bridge portion. Each engaging piece includes a second engaging hole. The connecting block comprises two pegs, each peg being extended through an associated one of the second engaging holes and then engaged in an associated one of the first engaging holes.

In yet another embodiment of the invention, a connecting plate is securely attached between the lenses and comprises two first engaging holes. The bridge portion of the frame comprises two engaging pieces respectively formed on an upper wall and a lower wall of the bridge portion. Each engaging piece includes a second engaging hole. The connecting plate comprises two pegs, each peg being extended through an associated one of the second engaging holes and then engaged in an associated one of the first engaging holes.

In still another embodiment of the invention, the bridge portion of the frame comprises two engaging pieces respectively formed on an upper wall and a lower wall of the bridge portion. Each engaging piece includes a peg. The connecting block comprises two engaging holes. Each peg is extended through an associated one of the engaging holes of the connecting plate. A connecting plate may be securely attached between the lenses.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
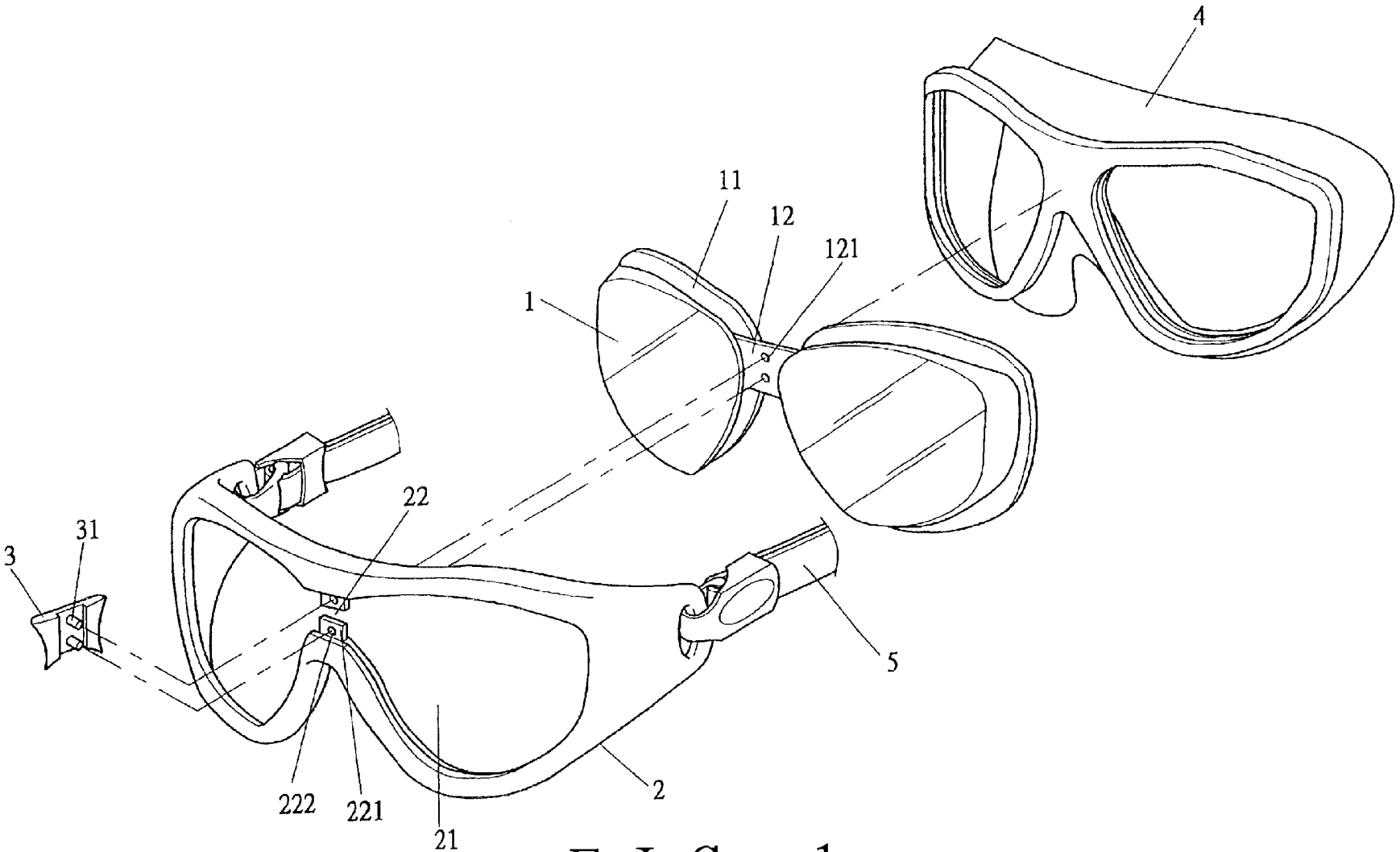
FIG. 1 is an exploded perspective view of a pair of swimming goggles in accordance with the present invention.

Referring to FIGS. 1 through 4, a pair of swimming goggles in accordance with the present invention generally includes a frame 2, two lenses 1, a padding member 4, and a head strap 5. Each lens 1 comprises a flange 11 on an outer periphery thereof for engaging with the frame 2 and the padding member 4. A connecting plate 12 may be mounted between the lenses 1 and comprises at least one engaging hole 121 (two in this embodiment), which will be described later.

The frame 2 is made of rigid material with slight flexibility and comprises a lens-holding compartment 21 having a bridge portion 22 in a middle thereof. The bridge portion 22 has at least one engaging piece 221 formed thereon. In this embodiment, an engaging piece 221 is formed on each of an upper wall and a lower wall of the bridge portion 22 and has an engaging hole 222, which will be described later. A connecting block 3 is mounted to the bridge portion and comprises two pegs 31 that respectively extend through the engaging holes 222 of the engaging pieces 221 and the engaging holes 121 of the connecting plate 12.

Figure 2:
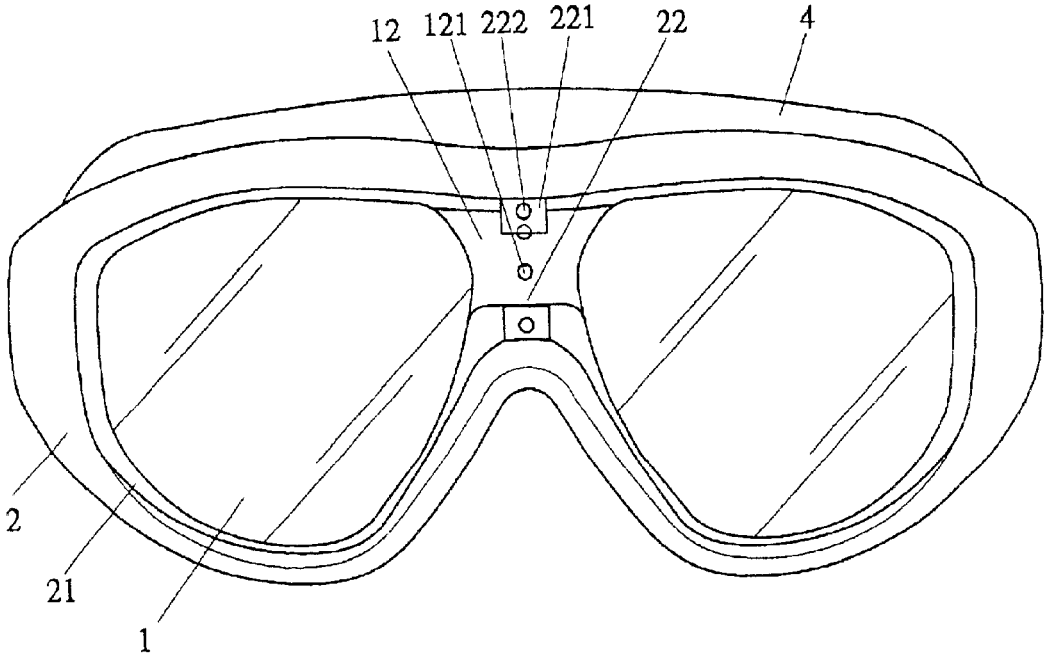
FIG. 2 is a front view illustrating an assembly procedure of the pair of swimming goggles in accordance with the present invention.
Figure 3:
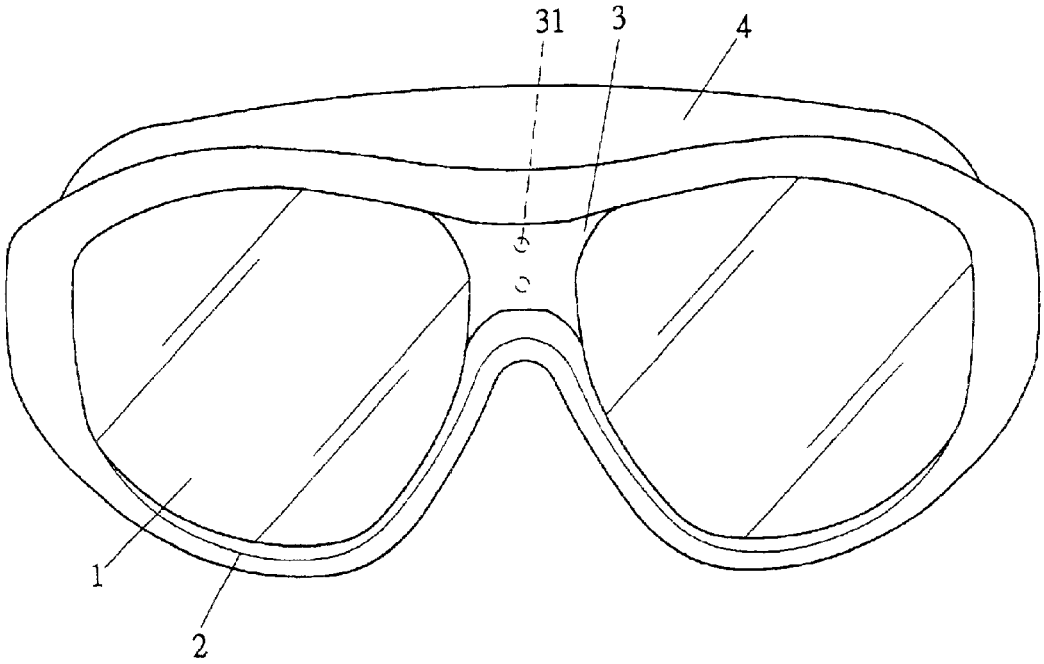
FIG. 3 is a front view of the pair of swimming goggles in accordance with the present invention.
Figure 4:
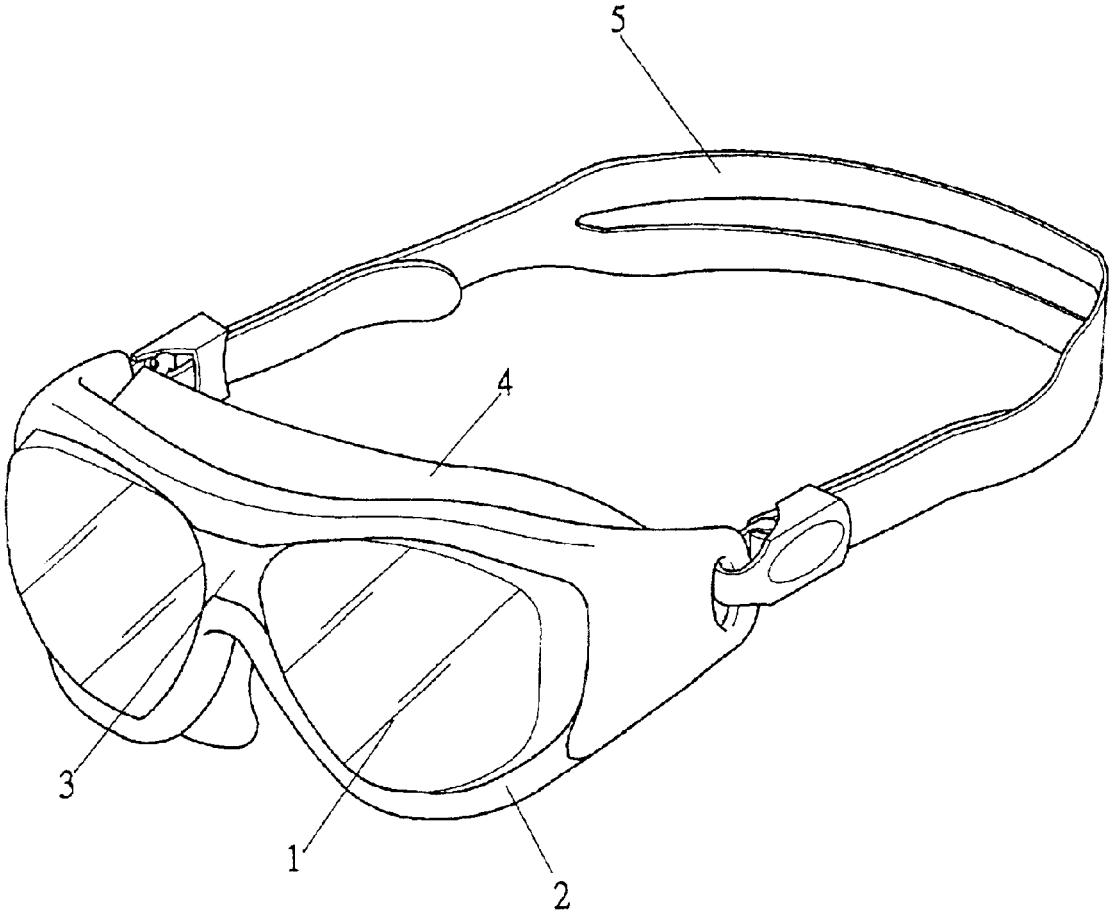
FIG. 4 is a perspective view of the pair of swimming goggles in accordance with the present invention.
Figure 5:
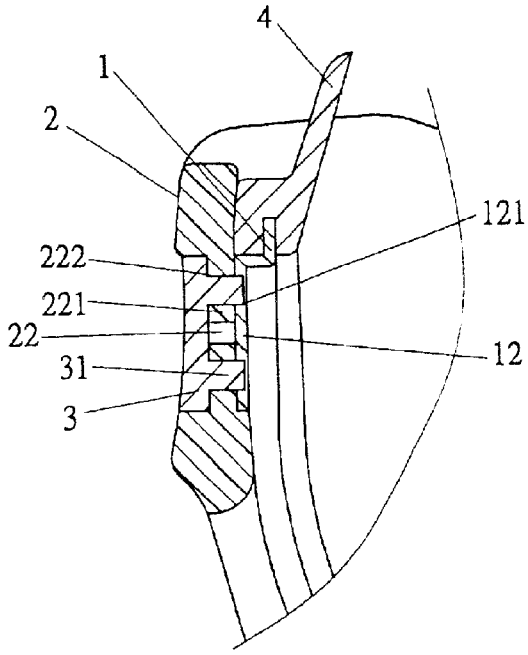
FIG. 5 is a partial view, partly exploded, of the pair of swimming goggles in accordance with the present invention.

In assembly, the lenses 1 are engaged with the padding member 4, and the frame 2 is pulled outward at the middle thereof so as to allow insertion of the flanges 11 of the lenses 1 into the lens-holding compartment 21, as shown in FIG. 2. The pegs 31 of the connecting block 3 are extended through the engaging holes 222 of the engaging pieces 221 and the engaging holes 121 of the connecting plate 12. Thus, the lens-receiving compartment 21 of the frame is tightly engaged with the flanges 11 of the lenses 1, as the pegs 31 of the connecting block 3 are force-fitted in the engaging holes 222 of the engaging pieces 221 and the engaging holes 121 of the connecting plate 12. As a result, the lenses 1 are less likely to disengage from the frame 2 after assembly. In addition, the connecting block 3 is completely received in the frame 2 and thus provides an aesthetically pleasing effect. FIGS. 3 through 5 respectively show a front view, perspective view, and sectional view of the pair of swimming goggles after assembly.

Figure 6:
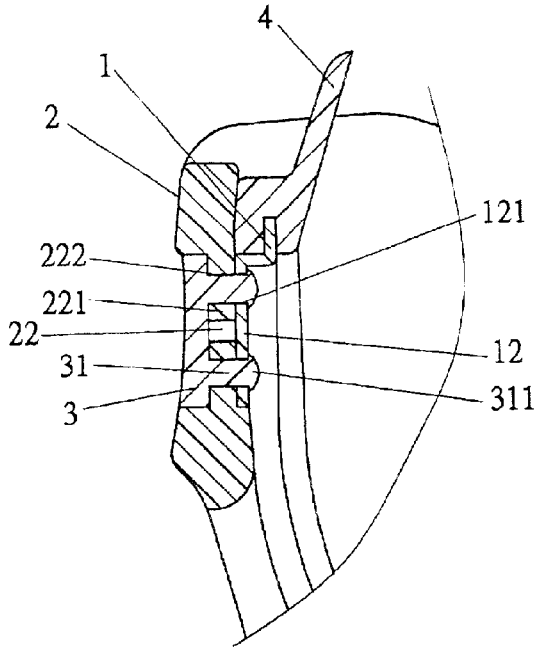
FIG. 6 is a view similar to FIG. 5, illustrating a modified embodiment of the invention.

In a modified embodiment shown in FIG. 6, each peg 31 of the connecting block 3 includes a resilient snapping head 311 having a diameter slightly greater than an inner diameter of an associated one of the engaging holes 121. The snapping head 311 is compressed inward when it is passing through the engaging hole 222 of the respective engaging piece 221 and the respective engaging hole 121 of the connecting plate 12. The snapping head 311 restores its shape after it has passed through the respective engaging hole 121 of the connecting plate 12. Thus, disengagement of the peg 31 of the connecting block 3 is prevented.

Figure 7:
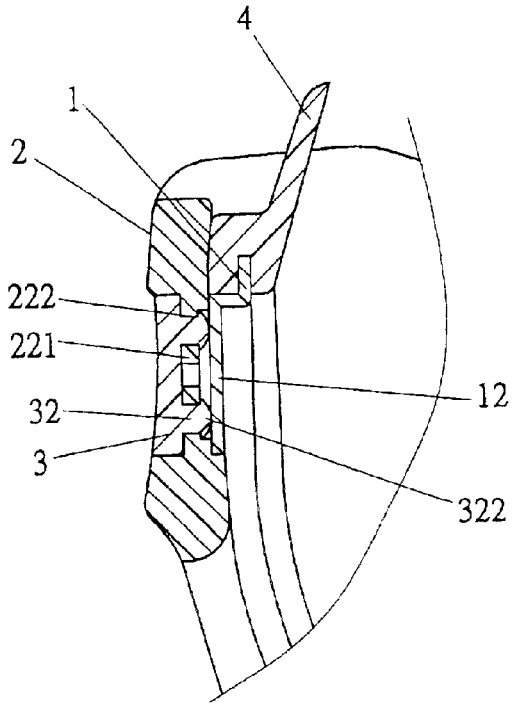
FIG. 7 is a view similar to FIG. 5, illustrating another modified embodiment of the invention.

FIG. 7 illustrates another modified embodiment of the invention, wherein each peg (now designated by 32) has a snapping head 322 having a diameter slightly greater than an inner diameter of an associated one of the engaging holes 222. The snapping head 322 is compressed inward when it is passing through the engaging hole 222 of the respective engaging piece 221. The snapping head 322 restores its shape after it has passed through the engaging hole 222 of the respective engaging piece 221. Thus, disengagement of the peg 31 of the connecting block 3 is prevented. The engaging holes 121 in the connecting plate 12 are omitted.

Figure 8:
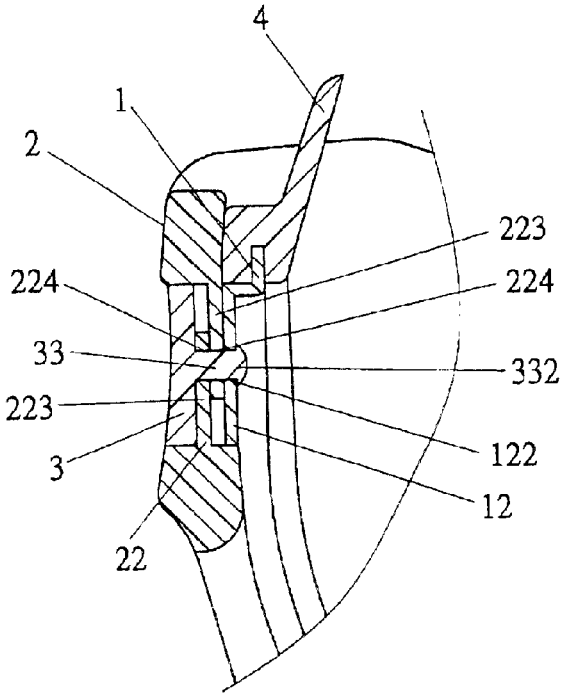
FIG. 8 is a similar to FIG. 5, illustrating a further modified embodiment of the invention.

FIG. 8 illustrates a further modified embodiment of the invention, wherein the bridge portion 22 of the frame 2 comprises a front engaging piece 223 extending upward from a lower wall of the bridge portion 22 and a rear engaging piece 223, extending downward from an upper wall of the bridge portion 22. The connecting block 3 comprises a peg 33 having a snapping head 332 having a diameter slightly greater than an inner diameter of the engaging hole 122 of the connecting plate 12. The snapping head 332 is compressed inward when it is passing through the engaging hole 224 in each respective engaging piece 223, and the engaging hole 122 of the connecting plate 12. The snapping head 332 restores its shape after it has passed through the engaging hole 122 of the connecting plate 12. Thus, disengagement of the peg 31 of the connecting block 3 is prevented.

Figure 9:
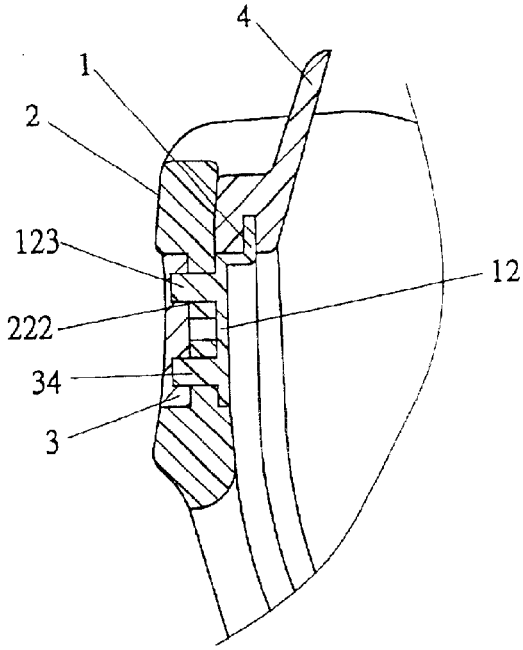
FIG. 9 is a similar to FIG. 5, illustrating still another modified embodiment of the invention.

It is noted that the connecting plate 12 can be omitted. The lenses 1 are retained in the frame 2 by the connecting block 3. Alternatively, the connecting block 3 may include at least one engaging hole, and the connecting plate 12 may include at least one peg that passes through the respective engaging hole(s) in the engaging piece(s) of the frame 2. FIG. 9 illustrates still another modified embodiment of the invention, wherein the connecting block 3 has two engaging holes 34 and the connecting plate 12 has two pegs 123. Each peg 123 is passed through the engaging hole 222 of the respective engaging piece 221 of the bridge portion 22 and securely engaged in the respective engaging hole 34 of the connecting block 3.

Figure 10:
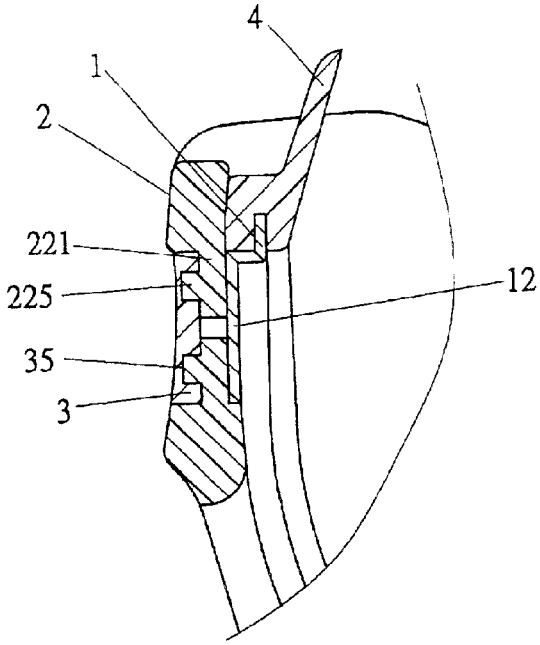
FIG. 10 is a similar to FIG. 5, illustrating yet another modified embodiment of the invention.
Figure 11:
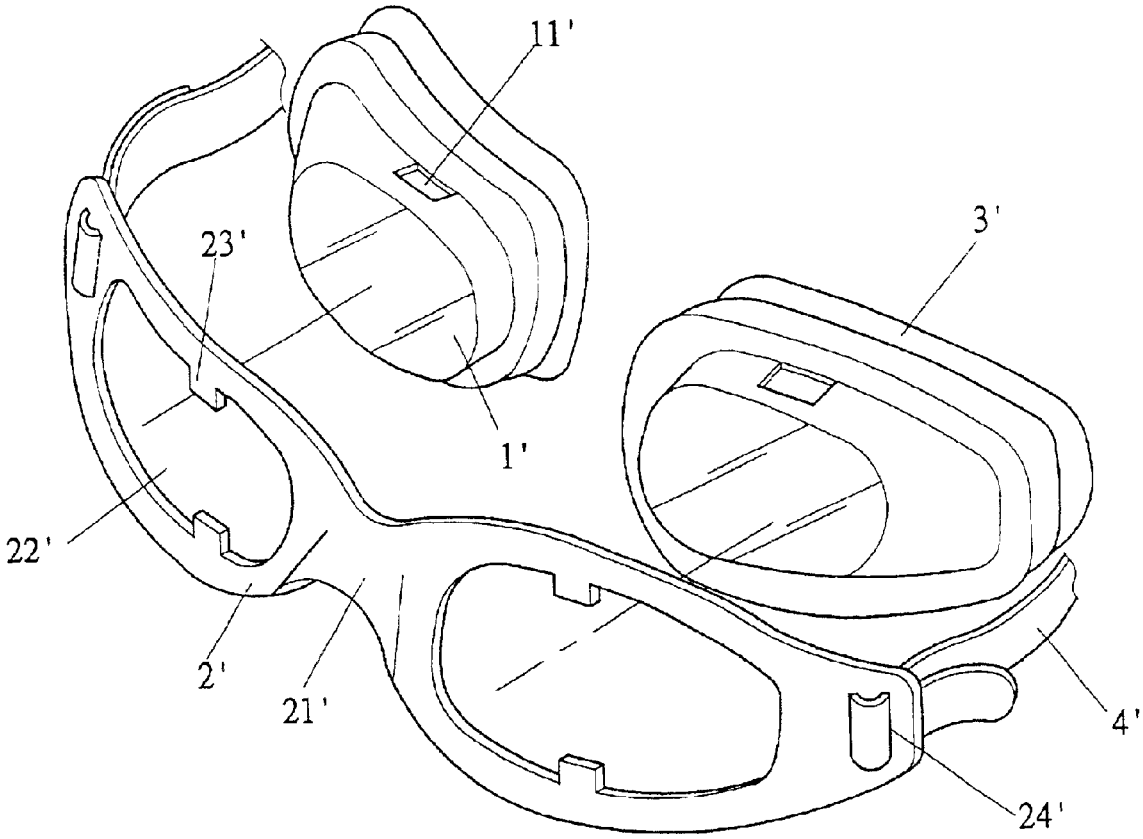
F I G . 11(PRIOR ART)
FIG. 11 is an exploded perspective view of a pair of conventional swimming goggles.
Figure 12:
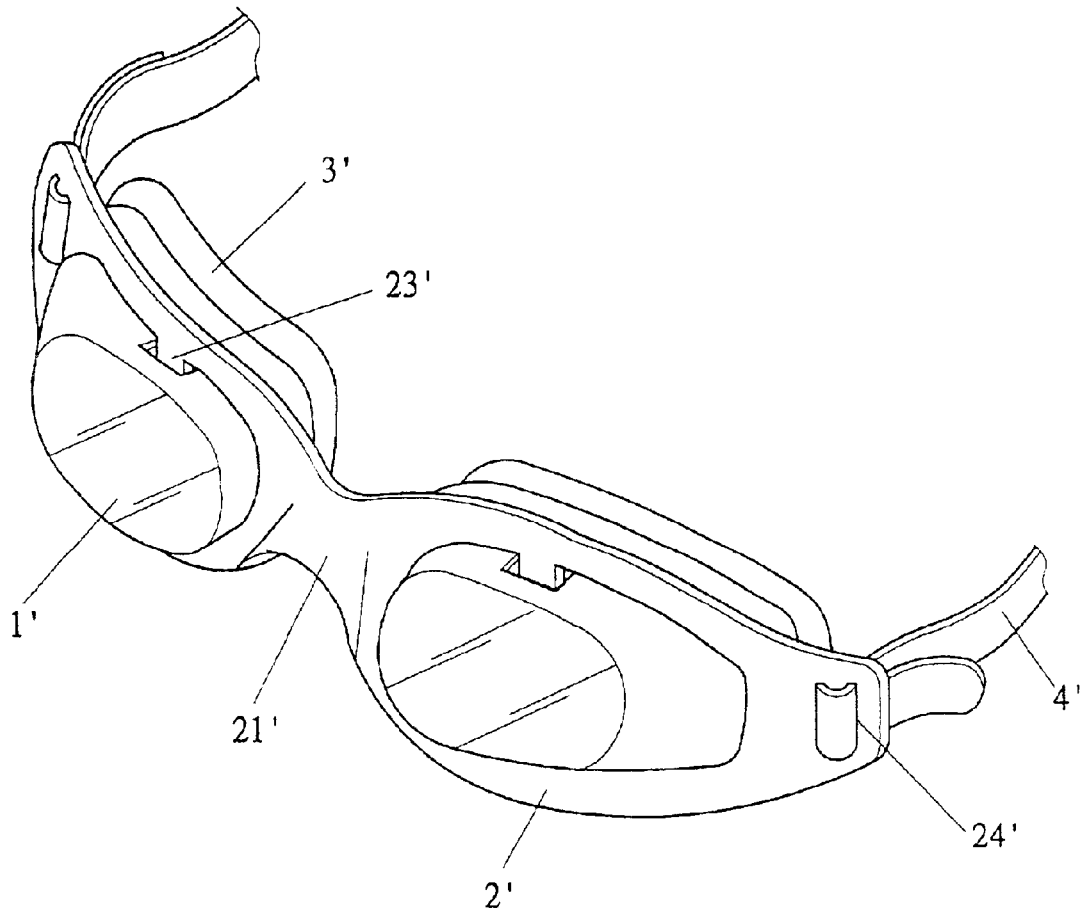
F I G . 12(PRIOR ART)
FIG. 12 is a perspective view of the pair of conventional swimming goggles in FIG. 11.

FIG. 10 illustrates yet another modified embodiment of the invention, wherein each engaging piece 221 of the bridge portion 22 includes a peg 225, and the connecting block 3 includes two engaging holes 35 for receiving the pegs 225.

Although the invention has been explained in relation to its preferred embodiment, it is to be understood that many other possible modifications and variations can be made without departing from the scope of the invention as hereinafter claimed.

What is claimed is:

1. A lens/frame assembly for swimming goggles, comprising:

a frame made of rigid material with slightly flexibility, the frame comprising a lens-holding compartment having a bridge portion in a middle thereof;

two lenses received in the lens-holding compartment of the frame; and a connecting block securely received in the bridge portion of the lens-holding compartment and securely mounted to the frame to thereby securely retain the lenses in place further comprising a connecting plate securely attached between the lenses, the connecting plate comprising a first engaging hole, the bridge portion of the frame comprising a front engaging piece and a rear engaging piece respectively formed on a lower wall and an upper wall of the bridge portion, the front engaging piece and the rear engaging piece including aligned second engaging holes, the connecting block comprising a peg having a snapping head having a diameter slightly greater than an inner diameter of the first engaging hole of the connecting plate, the snapping head being compressed inward when it is passing through the aligned second engaging holes and the first engaging hole, the snapping head restoring its shape after it has passed through the first engaging hole of the connecting plate.

2. A pair of swimming goggles comprising:

a frame made of rigid material with slight flexibility, the frame comprising a lens-holding compartment having a bridge portion in a middle thereof;

two lenses received in the lens-holding compartment of the frame, each said lens including a flange for engaging with the lens-holding compartment;

a connecting block securely received in the bridge portion of the lens-holding compartment and securely mounted to the frame;

a padding member engaged with the lenses; and a head strap having two ends attached to two sides of the frame;

wherein the bridge portion of the frame is pullable to allow insertion of the lenses into the lens-holding compartment and to allow engagement of the flange of each said lens with the lens-holding compartment, and wherein the flange of each said lens is tightly received in the lens-holding compartment of the frame further comprising a connecting plate securely attached between the lenses, the connecting plate comprising a first engaging hole, the bridge portion of the frame comprising a first engaging hole, the bridge portion of the frame comprising a front engaging piece and a rear engaging piece respectively formed on a lower wall and an upper wall of the bridge portion, the front engaging piece and the rear engaging piece including aligned second engaging holes, the connecting block comprising a peg having a snapping head having a diameter slightly greater than an inner diameter of the first engaging hole of the connecting plate, the snapping head being compressed inward when it is passing through the aligned second engaging holes and the first engaging hole, the snapping head restoring its shape after it has passed through the first engaging hole of the connecting plate.

3. A lens/frame assembly for swimming goggles, comprising:

a frame made of rigid material with slight flexibility, the frame comprising a lens-holding compartment having a bridge portion in middle thereof, with said bridge portion having an upper wall and a lower wall;

two lenses tightly received in the lens-holding compartment of the frame; and a connecting block securely received in the bridge portion of the lens-holding compartment and securely mounted to the frame to thereby securely retain the lenses in place, with the connecting block connecting the upper wall and the lower wall of the bridge portion, further comprising a connecting plate securely attached between the lenses, the connecting plate comprising two first engaging holes, the bridge portion of the frame comprising two engaging pieces respectively formed on an upper wall and a lower wall of the bridge portion, each said engaging piece including a second engaging hole, the connecting block comprising two pegs each having a snapping head having a diameter slightly greater than an inner diameter of an associated one of the first engaging holes, the snapping head being compressed inward when it is passing through an associated one of the second engaging holes and the associated one of the first engaging holes, the snapping head restoring its shape after it has passed through the associate done of the first engaging holes.

4. A lens/frame assembly for swimming goggles, comprising:

a frame made of rigid material with slight flexibility, the frame comprising a lens-holding compartment having a bridge portion in middle thereof, with said bridge portion having an upper wall and a lower wall;

two lenses received in the lens-holding compartment of the frame; and a connecting block securely received in the bridge portion of the lens-holding compartment and securely received in the bridge portion of the lens-holding compartment and securely mounted to the frame to thereby securely retain the lenses in place, with the connecting block connecting the upper wall and the lower wall of the bridge portion, further comprising a connecting plate securely attached between the lenses, the connecting plate comprising two first engaging holes, the bridge portion of the frame comprising two engaging pieces respectively formed on an upper wall and a lower wall of the bridge portion, each said engaging piece including a second engaging hole, the connecting block comprising two pegs, each said peg being extended through an associated one of the second engaging holes and then engaged in an associated one of the first engaging holes.

5. A lens/frame assembly for swimming goggles, comprising:

a frame made of rigid material with slight flexibility, the frame comprising a lens-holding compartment having a bridge portion in middle thereof, with said bridge portion having an upper wall and a lower wall;

two lenses received in the lens-holding compartment of the frame; and a connecting block securely received in the bridge portion of the lens-holding compartment and securely mounted to the frame to thereby securely retain the lenses in place, with the connecting block connecting the upper wall and the lower wall of the bridge portion, further comprising a connecting plate securely attached between the lenses, the connecting block comprising two first engaging holes, the bridge portion of the frame comprising two engaging pieces respectively formed on an upper wall and a lower wall of the bridge portion, each said engaging piece including a second engaging hole, the connecting plate comprising two pegs, each said peg being extended through an associated one of the second engaging holes and then engaged in an associated one of the first engaging holes.

6. A pair of swimming goggles comprising:

a frame made of rigid material with slight flexibility, the frame comprising a lens-holding compartment having a bridge portion in a middle thereof;

two lenses received in the lens-holding compartment of the frame, each said lens including a flange for engaging with the lens-holding compartment;

a connecting block securely received in the bridge portion of the lens-holding compartment and securely mounted to the frame;

a padding member engaged with the lenses; and a head strap having two ends attached to two sides of the frame;

wherein the bridge portion of the frame is pullable to allow insertion of the lenses into the lens-holding compartment and to allow engagement of the flange of each said lens with the lens-holding compartment, and wherein the flange of each said lens is tightly received in the lens-holding compartment of the lens-holding compartment of the frame further comprising a connecting plate securely attached between the lenses, the connecting plate comprising two first engaging holes, the bridge portion of the frame comprising two engaging pieces respectively formed on an upper wall and a lower wall of the bridge portion, each said engaging piece including a second engaging hole, the connecting block comprising two pegs each having a snapping head having a diameter slightly greater than an inner diameter of an associated one of the first engaging holes, the snapping head being compressed inward when it is passing through an associated one of the second engaging holes and the associated one of the first engaging holes, the snapping head restoring its shape after it has passed through the associated one of the first engaging holes.

7. A pair of swimming goggles comprising:

a frame made of rigid material with slight flexibility, the frame comprising a lens-holding compartment having a bridge portion in a middle thereof;

two lenses received in the lens-holding compartment of the frame, each said lens including a flange for engaging with the lens-holding compartment;

a connecting block securely received in the bridge portion of the lens-holding compartment and securely mounted to the frame;

a padding member engaged with the lenses; and a head strap having two ends attached to two sides of the frame;

wherein the bridge portion of the frame is pullable to allow insertion of the lenses into the lens-holding compartment and to allow engagement of the flange of each said lens with the lens-holding compartment, and wherein the flange of each said lens is tightly received in the lens-holding compartment of the frame further comprising a connecting plate securely attached between the lenses, the connecting plate comprising two first engaging holes, the bridge portion of the frame comprising two engaging pieces respectively formed on an upper wall and a lower wall of the bridge portion, each said engaging piece including a second engaging hole, the connecting block comprising two pegs, each said peg being extended through an associated one of the second engaging holes and then engaged in an associated one of the first engaging holes.

8. A pair of swimming goggles comprising:

a frame made of rigid material with slight flexibility, the frame comprising a lens-holding compartment having a bridge portion in a middle thereof;

two lenses received in the lens-holding compartment of the frame, each said lens including a flange for engaging with the lens-holding compartment;

a connecting block securely received in the bridge portion of the lens-holding compartment and securely mounted to the frame;

a padding member engaged with the lenses; and a head strap having two ends attached to two sides of the frame;

wherein the bridge portion of the frame is pullable to allow insertion of the lenses into the lens-holding compartment and to allow engagement of the flange of each said lens with the lens-holding compartment, and wherein the flange of each said lens is tightly received in the lens-holding compartment of the frame further comprising a connection plate securely attached between the lenses, the connecting block comprising two first engaging holes, the bridge portion of the frame comprising two engaging pieces respectively formed on an upper wall and a lower wall of the bridge portion, each said engaging piece including a second engaging hole, the connecting plate comprising two pegs, each said peg being extended through an associated one of the second engaging holes and then engaged in an associated one of the first engaging holes.

* * * * *